US008678027B2

(12) United States Patent
Ando et al.

(10) Patent No.: US 8,678,027 B2
(45) Date of Patent: Mar. 25, 2014

(54) EXHAUST PASSAGE COMPONENT

(75) Inventors: Yoshio Ando, Aichi (JP); Makoto Takeuchi, Aichi (JP)

(73) Assignee: Paloma Co., Ltd., Aichi (JP)

( * ) Notice: Subject to any disclaimer, the term of this patent is extended or adjusted under 35 U.S.C. 154(b) by 118 days.

(21) Appl. No.: 13/311,748

(22) Filed: Dec. 6, 2011

(65) Prior Publication Data

US 2012/0138163 A1 Jun. 7, 2012

(30) Foreign Application Priority Data

Dec. 7, 2010 (JP) ..... 2010-272609

(51) Int. Cl.
*F16T 1/34* (2006.01)

(52) U.S. Cl.
USPC ..... 137/177; 137/587; 137/544

(58) Field of Classification Search
USPC ..... 137/171, 177, 583, 587, 544–546; 251/127; 138/42
See application file for complete search history.

(56) References Cited

U.S. PATENT DOCUMENTS 3,685,534 A * 8/1972 Straitz, III ..... 137/171
4,531,653 A * 7/1985 Sakata ..... 220/746
4,552,166 A * 11/1985 Chadbourne et al. ..... 137/15.04
6,913,040 B2 * 7/2005 Crossman et al. ..... 137/587

FOREIGN PATENT DOCUMENTS

JP 2007033000 2/2007
JP 2009092286 4/2009

OTHER PUBLICATIONS

Machine translation for JP 2007-033000.*
Machine translation for JP 2007-033000; Publication date Feb. 8, 2007.*
Notice of Reason(s) for Rejection dated Aug. 21, 2012 issued in the corresponding Japanese Patent Application No. 2010-272609. 4 pages.

* cited by examiner

*Primary Examiner* — Craig Schneider
*Assistant Examiner* — Ian Paquette
(74) *Attorney, Agent, or Firm* — James L. Young; Westman, Champlin & Koehler, P.A.

(57) ABSTRACT

An exhaust passage component includes: an inner space used as part of an exhaust passage of a hot water supply apparatus; a drainage passage configured such that if condensed water is produced in the inner space, the condensed water is caused to flow out of the inner space; a first sheet metal member, at least part of which includes a first recess formed by drawing and a plate-like portion formed around the first recess; and a second sheet metal member, at least part of which includes a second recess by drawing and a flange formed around the second recess.

3 Claims, 6 Drawing Sheets

EXHAUST PASSAGE COMPONENT

CROSS-REFERENCE TO RELATED APPLICATIONS

This application claims the benefit of Japanese Patent Application No. 2010-272609 filed Dec. 7, 2010 in the Japan Patent Office, the disclosure of which is incorporated herein by reference.

BACKGROUND

The present invention relates to an exhaust passage component used for constituting an exhaust passage for conveying combustion exhaust generated in a combustion apparatus out of the apparatus.

For example, as disclosed in Japanese Unexamined Patent Application Publication No. 2009-92286, a hot water supply apparatus of latent heat recovery type is known, which includes a primary heat exchanger for recovering mainly sensible heat from combustion exhaust, and a secondary heat exchanger for recovering mainly latent heat from the exhaust, a temperature of which has decreased as a result of heat exchange in the primary heat exchanger.

In this type of hot water supply apparatus, as the temperature of combustion exhaust in the secondary heat exchanger decreases, a relative humidity of combustion exhaust becomes significantly high. This results in production of condensed water (drainage water) within the exhaust passage. Therefore, a drainage discharge pipe is provided to drain the condensed water, and a neutralizer or the like is also provided to neutralize acidic condensed water.

SUMMARY

The secondary heat exchanger of a hot water supply apparatus of latent heat recovery type has a structure in which a heat transfer pipe is passed through an inside of a casing that defines a flowing space for combustion exhaust, and exhaust passage components, such as an exhaust cylinder and an exhaust top, are directly attached to the casing of the secondary heat exchanger. Where condensed water is produced as described above, the condensed water is discharged via the drainage discharge pipe attached to the casing of the secondary heat exchanger.

However, for example, to make the hot water supply apparatus more compact and thinner, a space in which the drainage discharge pipe is disposed is limited depending on a structure of the hot water supply apparatus. Therefore, there has been difficulty in directly attaching the drainage discharge pipe to the casing of the secondary heat exchanger as described above.

Additionally, to prevent large foreign matter (foreign matter with a size approximate to that of a grain of sand, for example) that has entered a discharge passage for condensed water from flowing into a neutralizer, a component dedicated to removal of foreign matter has to be added, for example, by providing a dedicated filter at a certain point in a discharge passage or the like. This results in such problems as: the structure may easily become more complicated, the cost may become higher due to the added component, and more man hours for assembly may also be required.

The present invention provides an exhaust passage component able to ensure a drainage passage without directly connecting a pipe to a secondary heat exchanger and also able to suppress entry of large foreign matter into the drainage passage.

The configuration adopted for the present invention will now be described below.

An exhaust passage component according to the present invention includes: an inner space used as part of an exhaust passage of a hot water supply apparatus; a drainage passage configured such that if condensed water is produced in the inner space, the condensed water is caused to flow out of the inner space; a first sheet metal member, at least part of which includes a first recess formed by drawing and a plate-like portion formed around the first recess; and a second sheet metal member, at least part of which includes a second recess formed by drawing and a flange formed around the second recess. The first and second sheet metal members are joined, with the plate-like portion and the flange abutting each other. The second recess defines the inner space between the first sheet metal member and the second recess. The first sheet metal member has an upstream opening allowing exhaust to flow from upstream of the exhaust passage into the inner space whereas the second sheet metal member has a downstream opening allowing exhaust to flow from the inner space to downstream of the exhaust passage. Further, the flange has a through-hole serving as an exit of the drainage passage. The first recess is formed in a range where the first recess overlaps part of the second recess and the through-hole, as viewed from a direction perpendicular to abutting faces of the plate-like portion and the flange, thereby defining the drainage passage.

According to the exhaust passage component with the foregoing configuration, using such a simple method in which the sheet metal components processed by drawing are combined, it is possible to provide the inner space serving as part of the exhaust passage, and the drainage passage configured such that if condensed water is produced in the inner space, the condensed water is caused to flow out of the inner space.

In addition, since the through-hole serving as the exit of the drainage passage is formed in the flange, a pipe connected to the exit of the drainage passage can be disposed in a space adjacent to the second recess. Accordingly, compared to the case where the exit is formed in a bottom of the second recess, a dimension perpendicular to abutting faces of the first sheet metal member and the second sheet metal member can be reduced.

The formation of the through-hole, serving as the exit of the drainage passage, in the flange makes it possible not only to form the through-hole at the same time that the second recess is formed by drawing, but also to form the through-hole in a separate process after the second recess is formed by drawing. Therefore, unlike a configuration in which the exit of the drainage passage is formed in a peripheral wall of the second recess, the need to form the second recess and the through-hole in different processes can be obviated, thus increasing the degree of freedom in manufacturing process. Hence, man hours for processing steps can be reduced by forming the second recess and the through-hole at the same time.

Furthermore, by adjusting a depth of the first recess, a maximum width of a space serving as a drainage passage can be set arbitrarily. Therefore, the maximum width can be set to a narrow width that prevents entry of large foreign matter into the drainage passage.

In the exhaust passage component according to the present invention, it is preferable that, as viewed from the direction perpendicular to the abutting faces of the plate-like portion and the flange, a maximum size of foreign matter that can enter the drainage passage be predetermined by an overlapping portion where the flange and the bottom of the first recess overlap, and that the overlapping portion have an inclination such that foreign matter blocked by the overlapping portion from entering the drainage passage gathers toward a lower end of the inclination along the inclination by its own weight.

According to the exhaust passage component with the foregoing configuration, foreign matter prevented from entering the drainage passage gathers toward the lower end of the inclination along the inclination by its own weight. Accordingly, clogging at an entrance to the drain passage can be suppressed.

In the exhaust passage component according to the present invention, it is preferable that the bottom of the first recess have a third recess extending further from the bottom of the first recess, and in a position facing the flange, as viewed from a direction perpendicular to abutting faces of the first and second plate-like sheet metals.

According to the exhaust passage component with the foregoing configuration, in which the bottom of the first recess has the third recess extending further from the bottom of the first recess, a capacity of the drain passage can be increased compared with a case without such third recess. Therefore, condensed water can be introduced to the drainage passage more smoothly.

BRIEF DESCRIPTION OF THE DRAWINGS

The present invention will now be described below, by way of example, with reference to accompanying drawings, in which.

DETAILED DESCRIPTION OF THE PREFERRED EMBODIMENT

[Structure of Hot Water Supply Apparatus]

Figure 1:
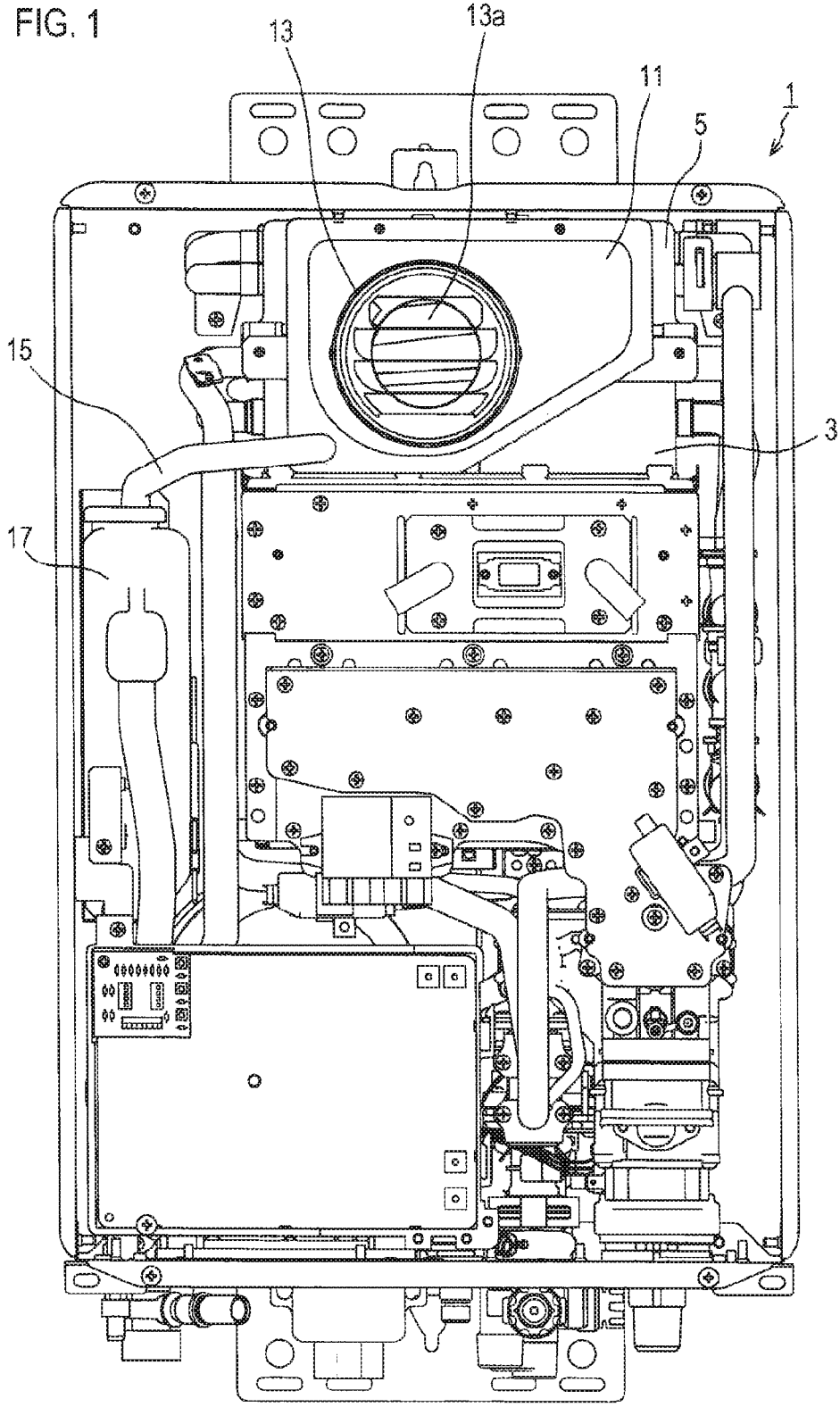
FIG. 1 is a view illustrating an inner configuration of a hot water supply apparatus.

A hot water supply apparatus 1 shown in FIG. 1 is a combustion apparatus of a latent heat recovery type, which recovers sensible heat and latent heat from combustion exhaust. The hot water supply apparatus 1 includes: a primary heat exchanger 3 for recovering mainly sensible heat from combustion exhaust; and a secondary heat exchanger 5 for recovering mainly latent heat from exhaust the temperature of which has decreased as a result of heat exchange in the primary heat exchanger 3.

The secondary heat exchanger 5 has a structure including a casing having an inside for use as a flow space for combustion exhaust; and a heat transfer pipe passed through the inside of the casing. A bottom surface of the casing inclines at a downward gradient from a rear side toward a front side of the hot water supply apparatus 1.

An exhaust top 11 is mounted forward from the secondary heat exchanger 5 (on a front side of the paper surface of FIG. 1). An exhaust cylinder 13 is attached to a front of the exhaust top 11. As viewed from the front, the exhaust top 11 and the exhaust cylinder 13 are located such that an upper portion of the exhaust top 11 overlaps the secondary heat exchanger 5, and a lower portion of the exhaust top 11 overlaps the primary heat exchanger 3.

Exhaust which undergoes heat exchange in the secondary heat exchanger 5 flows into the exhaust top 11 from a rear of the exhaust top 11 and then flows into the exhaust cylinder 13 attached to the front of the exhaust top 11, and is discharged out of the hot water supply apparatus 1 from an opening 13*a* formed in a front of the exhaust cylinder 13.

In such a combustion apparatus of latent heat recovery type, when an exhaust temperature decreases as a result of heat exchange in the secondary heat exchanger 5, relative humidity in exhaust increases with the decrease of the exhaust temperature. Consequently, water vapor in the exhaust condenses and condensed water (drain water) is produced.

When condensed water is produced in the casing of the secondary exchanger 5, the condensed water flows toward a front of the hot water supply apparatus 1 along the inclined bottom surface of the casing of the secondary heat exchanger 5, and flows into the exhaust top 11. In addition, condensed water produced in the exhaust cylinder 13 also flows into the exhaust top 11.

Therefore, one end of a drainage discharge pipe 15 is connected to a lower left portion of the discharge top 11, and the other end of the drainage discharge pipe 15 is connected to a neutralizer 17. The neutralizer 17 is provided for neutralizing acidic condensed water containing nitrogen oxides and sulfur oxides. The neutralizer 17 contains a neutralizing agent for neutralizing condensed water.

[Structure of Exhaust Top]

Figure 2:
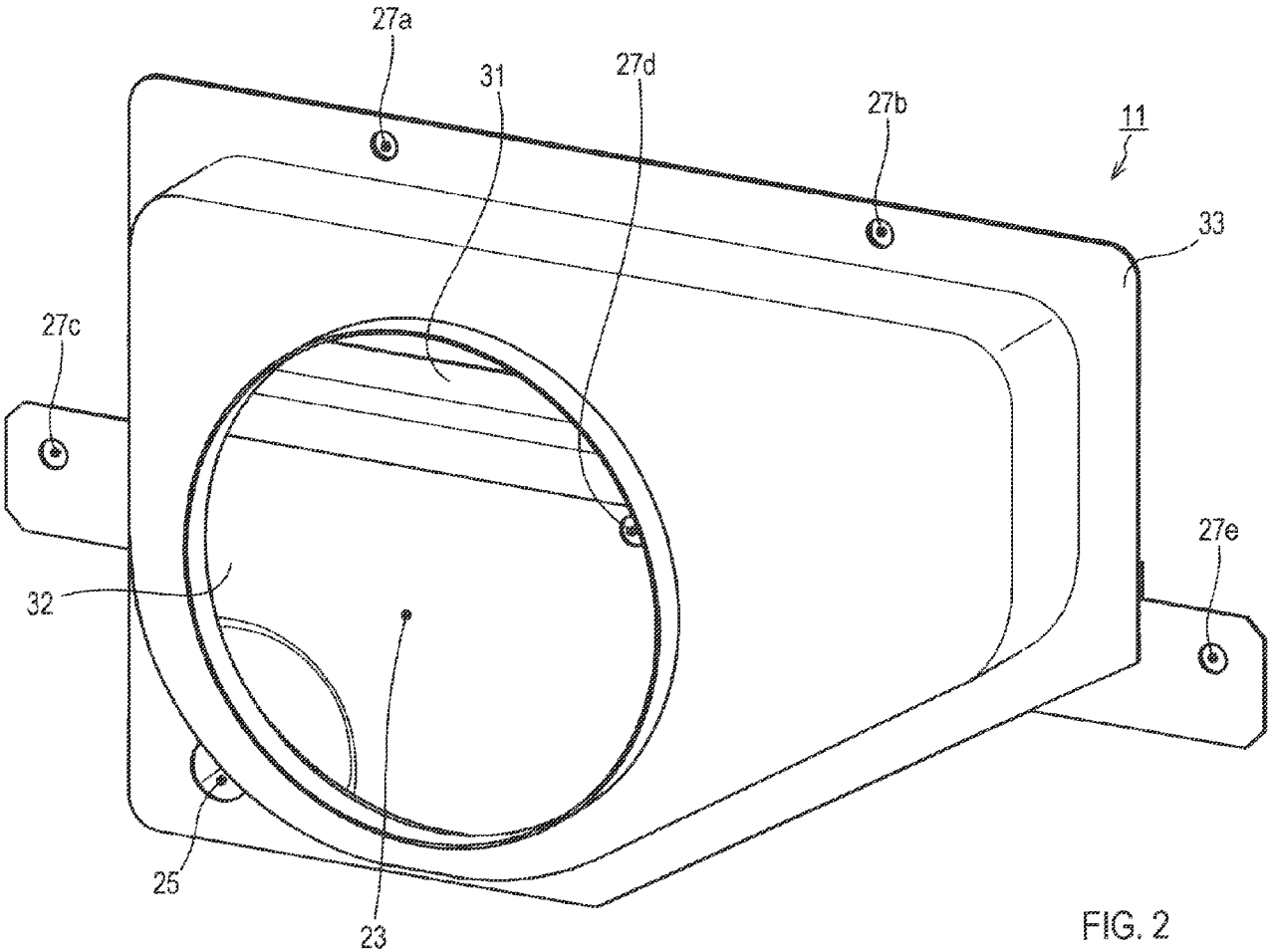
FIG. 2 is a perspective view of an exhaust top.
Figure 6:
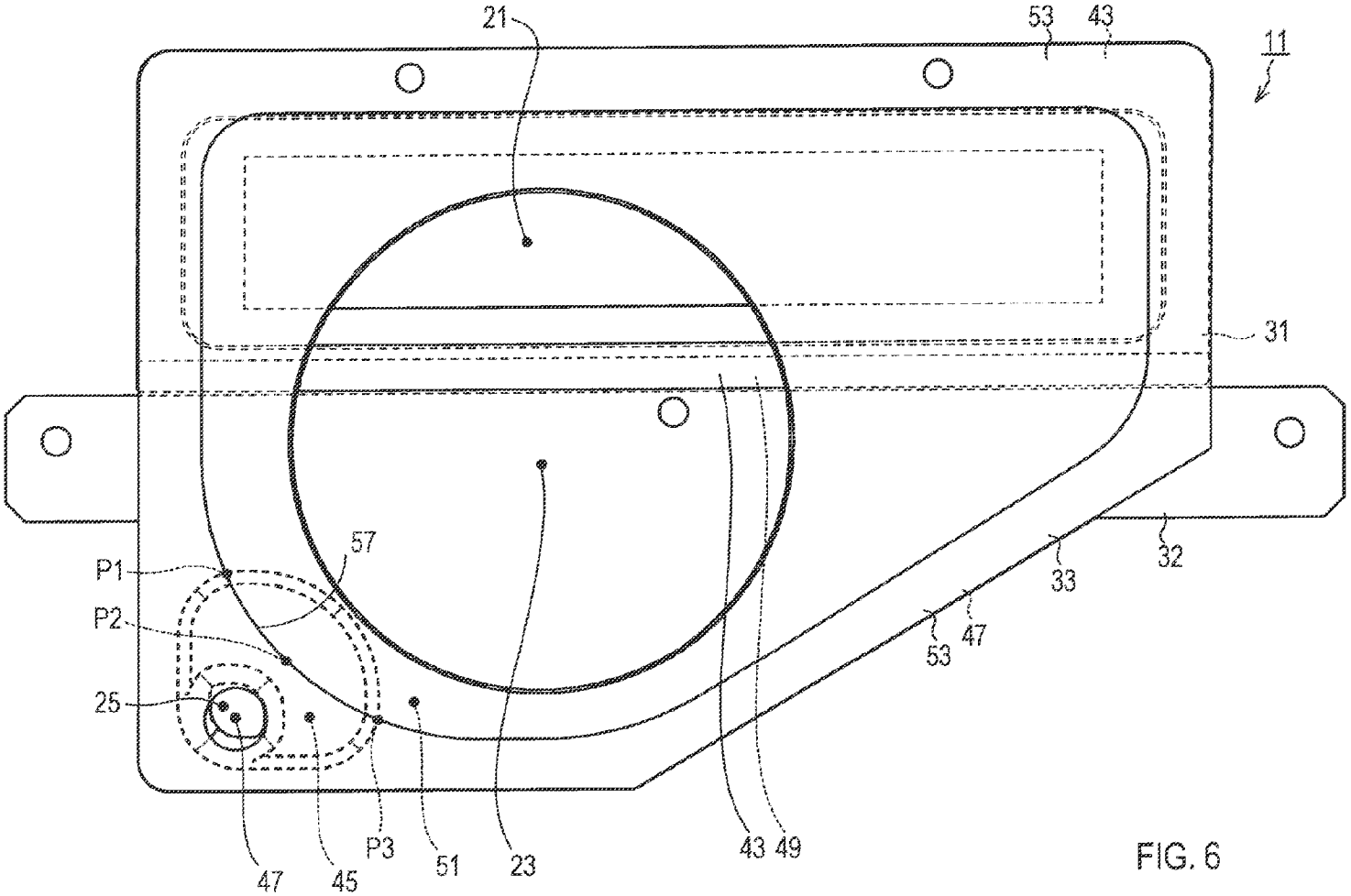
FIG. 6 is a view illustrating the positional relations of the recesses of the exhaust top.

As shown in FIG. 2 and FIG. 6, the exhaust top 11 includes: an upstream opening 21 allowing exhaust to flow to an inner space of the exhaust top 11 from the secondary heat exchanger 5; and a downstream opening 23 allowing exhaust to flow out toward the exhaust cylinder 13 from the inner space of the exhaust top 11.

The exhaust top 11 also includes a drainage passage opening 25 to which the one end of the drainage discharge pipe 15 is connected, and through-holes 27*a* to 27*e* used for screwing the exhaust top 11.

The exhaust top 11 with the above structure is manufactured by welding the following three sheet-metal components: an exhaust-top rear upper component 31, an exhaust-top rear lower component 32, and an exhaust-top front component 33. Each of the three sheet metal components is a metal component having a recess formed by drawing with a press.

Figure 3C:
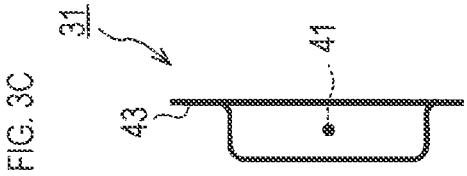
FIG. 3C is a side view of the exhaust-top rear upper component.
Figure 3A:
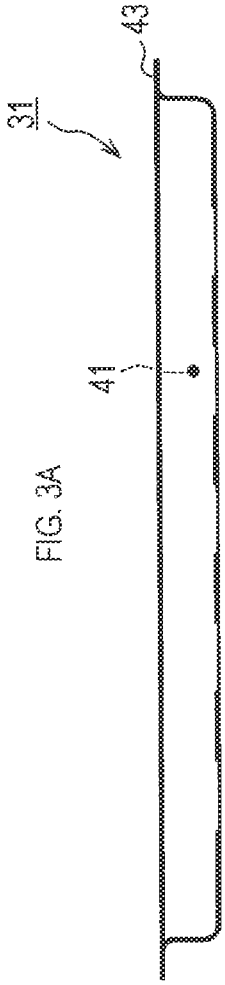
FIG. 3A is a top view of the exhaust-top rear upper component.
Figure 3B:
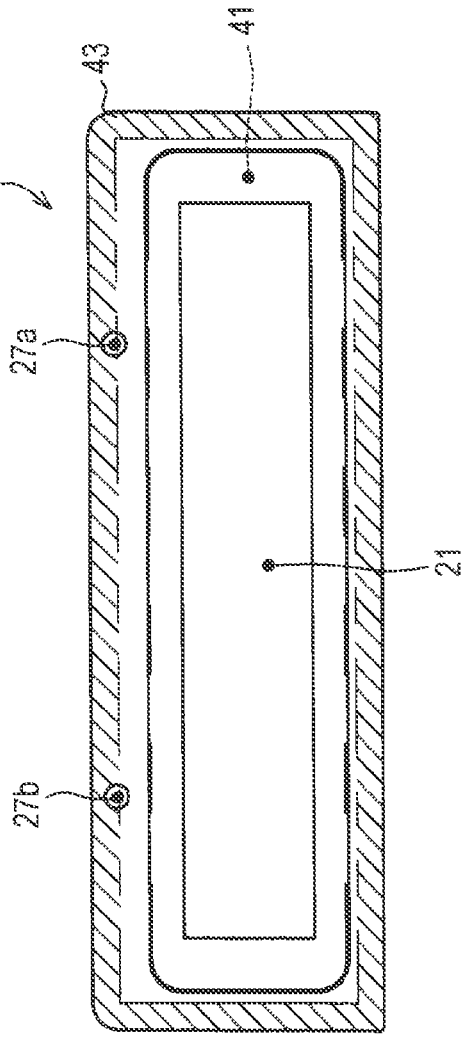
FIG. 3B is a front view of the exhaust-top rear upper component.

To be more specific, the exhaust-top rear upper component 31 has a recess 41 formed by drawing, as shown in FIGS. 3A, 3B, and 3C. The recess 41 defines part of the inner space of the exhaust top 11. Additionally, the upstream opening 21 is formed in a place corresponding to a bottom of the recess 41.

A flange 43 is formed around the recess 41, and the through-holes 27*a* and 27*b* are formed in the flange 43. Of the flange 43, a region indicated by hatched lines in FIG. 3B is used as a welding area with respect to the exhaust-top rear lower component 32 or the exhaust-top front component 33.

Figure 4C:
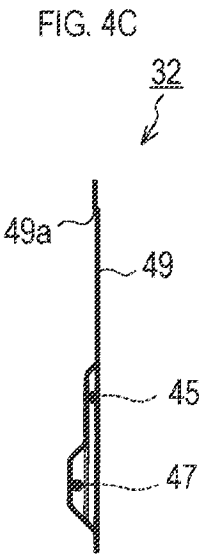
FIG. 4C is a front view of the exhaust-top rear lower component.
Figure 4A:
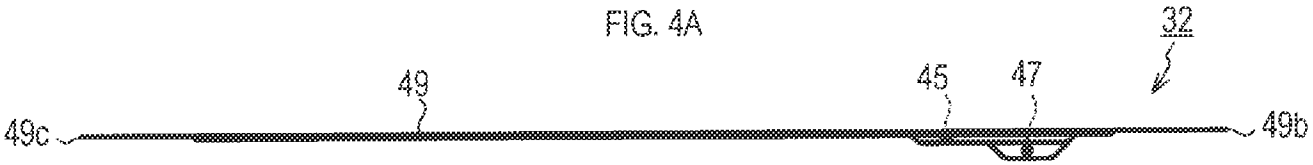
FIG. 4A is a top view of the exhaust-top rear lower component.
Figure 4B:
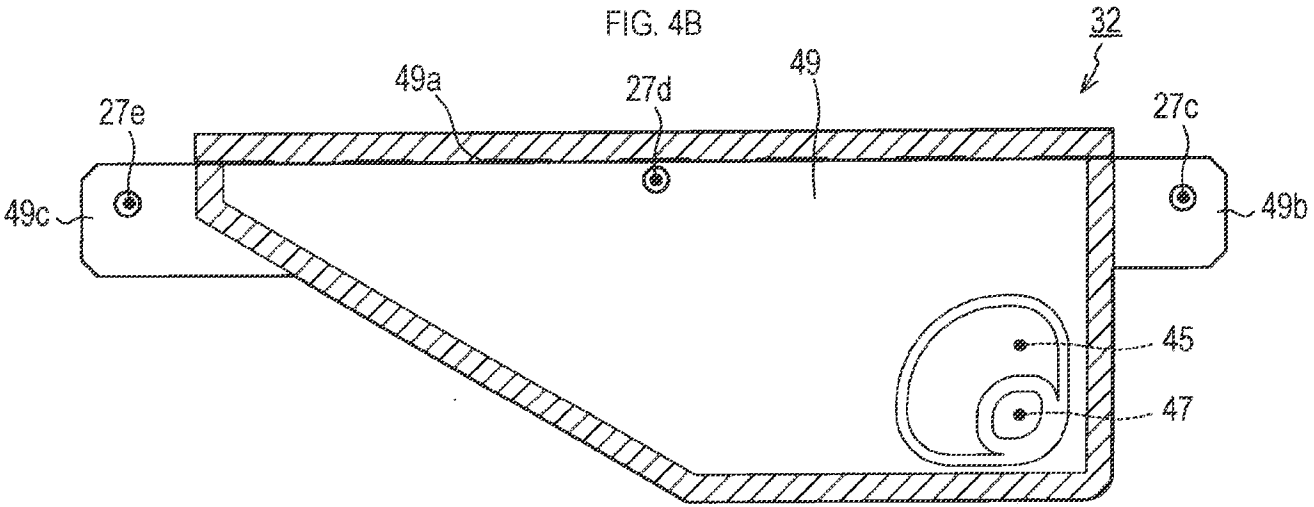
FIG. 4B is a side view of the exhaust-top rear lower component.

The exhaust-top rear lower component 32 has recesses 45 and 47 formed by drawing, as shown in FIGS. 4A, 4B, and 4C. The recess 47 is formed in a bottom of the recess 45. The recesses 45 and 47 thus form a stepped recess together.

The recesses 45 and 47 define part of the inner space of the exhaust top 11, and also define a drainage passage by which the inner space of the exhaust top 11 and the drainage passage opening 25 communicate with each other. A detailed description of the drainage passage will be given later.

Formed around the recess 45 is a plate-like portion 49. Of the plate-like portion 49, a region indicated by hatched lines in FIG. 4B is used as a welding area with respect to the exhaust-top rear upper component 31 or the exhaust-top front component 33.

Upper edges 49*a* of the plate-like portion 49 have steps. Thus, when the welding portions of the exhaust-top upper component 31 and exhaust-top rear lower component 32 are placed one on the other, the faces of the components 31 and 32 opposite the exhaust-top front component 33 are located in a same plane. Formed near an upper center part of the plate-like portion 49 is the through-hole 27*d* mentioned above. Furthermore, side ends 49*b* and 49*c* of the plate-like portion 49 have the through-holes 27*c* and 27*e*, respectively.

Figure 5A:
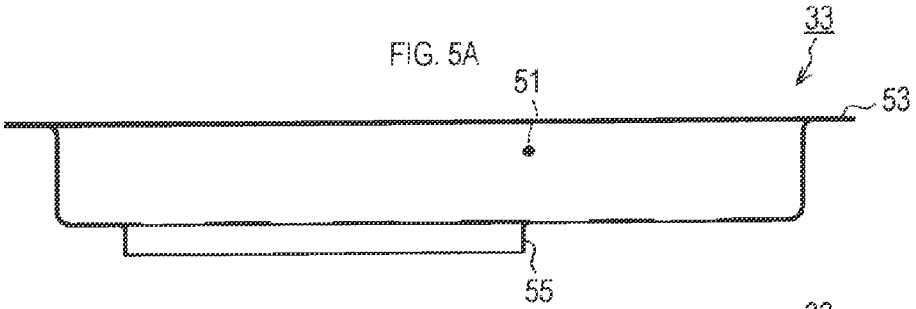
FIG. 5A is a top view of the exhaust-top front component.
Figure 5B:
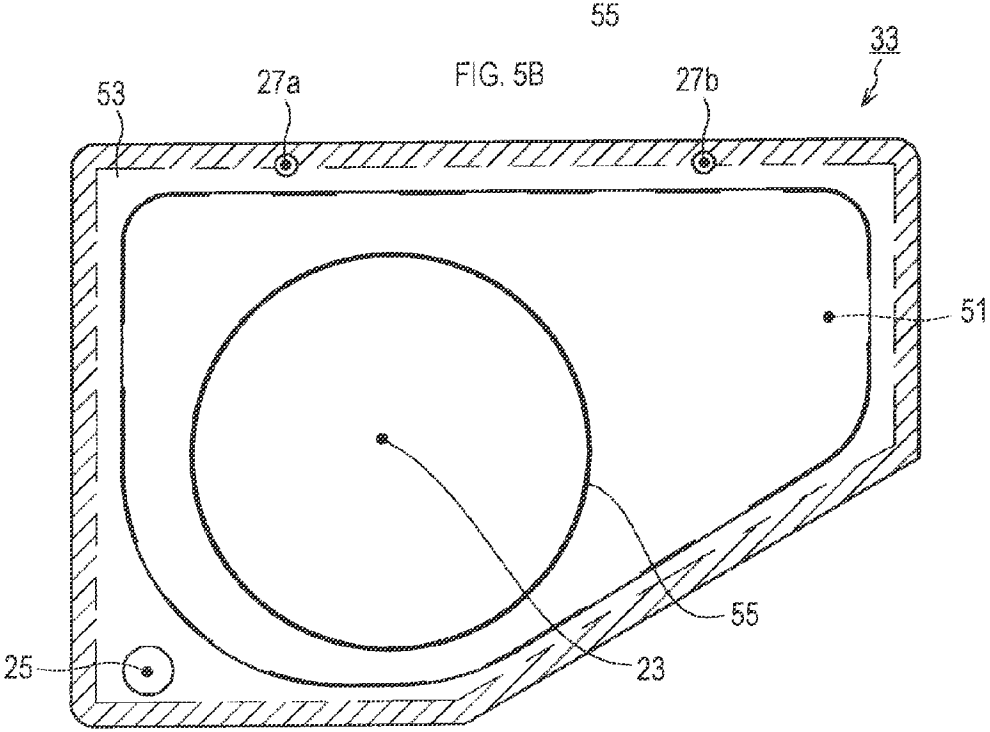
FIG. 5B is a side view of the exhaust-top front component.
Figure 5C:
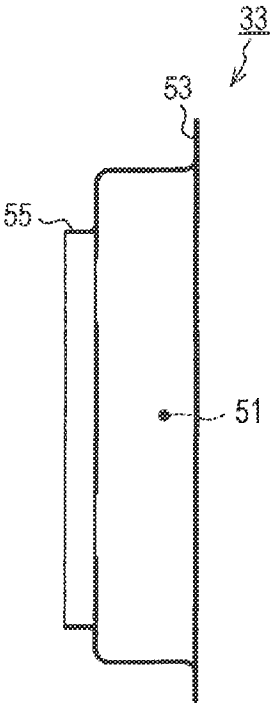
FIG. 5C is front view of the exhaust-top front component.

The exhaust-top front component 33 has a recess 51 formed by drawing, as shown in FIGS. 5A, 5B, and 5C. The recess 51 defines part of the inner space of the exhaust top 11. Formed in a place corresponding to a bottom of the recess 51 is the above-mentioned downstream opening 23.

Formed around the recess 51 is a flange 53, and formed in the flange 53 is the drainage passage opening 25 described above. Of the flange 53, a region indicated by hatched lines in FIG. 5B is used as a welding area with respect to the exhaust-top rear upper component 31 or the exhaust-top rear lower component 32. Additionally, a cylindrical portion 55 projects around the downstream opening 23 and opposite the recess 51. The cylindrical portion 55 is used for connecting the exhaust cylinder 13.

When the exhaust-top rear upper component 31, exhaust-top rear lower component 32, and the exhaust-top front component 33 are fitted together in positional relations as shown in FIG. 6, the faces of the flange 43, the plate-like portion 49, and the flange 53 contact one another. In this state, the exhaust-top rear upper component 31, the exhaust-top rear lower component 32, and the exhaust-top front component 33 are welded to one another in the welding areas described above. Thus, the exhaust top 11 is composed.

In the exhaust top 11 as above, the recess 45 formed in the exhaust-top rear lower component 32 and the recess 51 formed in the exhaust-top front component 33 are located so as to partially overlap each other as viewed from front (see FIG. 6). Through an overlapping area, the recess 45 and 51 communicate with each other.

Therefore, condensed water flowing into the exhaust top 11 from the secondary exchanger 5 or condensed water produced in the exhaust top 11 flows from the recess 51 to the recess 45, then finally reaches the drainage passage opening 25 via the recess 47, and is discharged into the neutralizer 17 through the drainage discharge pipe 15, shown in FIG. 1.

Accordingly, providing the exhaust top 11 as above eliminates a need to directly connect the drainage discharge pipe 15 to the secondary heat exchanger 5. Therefore, even where it is difficult to directly attach the drainage discharge pipe 15 to the secondary heat exchanger 5 due to the structure of the secondary heat exchanger 5 as a result of, for example, making the secondary heat exchanger 5 more compact and thinner, a passage for discharging condensed water via the exhaust top 11 can be ensured.

Additionally, of a boundary between the recess 51 and flange 53, a boundary portion 57 from a point P1, through a point P2, to a point P3, shown in FIG. 6, and the recess 45 define a space corresponding to a depth of the recess 45. However, the depth of the recess 45 is relatively shallow. Specifically, taking into account of an assumed size of foreign matter desired to be prevented from entering the neutralizer, the depth of the recess 45 is smaller than the assumed size of the foreign matter.

Therefore, even if foreign matter larger than the assumed size enters from, for example, the downstream opening 23, such foreign matter is blocked by the boundary portion 57, and prevented from entering beyond the boundary portion 57. Thus, the apparatus can deal with the entry of foreign matter without providing a dedicated filter separately from the exhaust top 11. Since there is no need to add a dedicated component to deal with foreign matter, the structure of the apparatus can be simplified and costs arising from addition of the component can be avoided.

In the embodiment described above, the exhaust top 11 is one example of the exhaust passage component of the present invention. Also, the exhaust-top rear upper component 31 and the exhaust-top rear lower component 32 are examples of the first sheet metal members of the present invention, and the exhaust-top front component 33 is an example of the second sheet metal member. That is, the first and the second sheet metal members may be composed as a single sheet metal component, or may be composed by joining two or more sheet metal components.

In the foregoing embodiment, the recess 45 and the recess 51 are examples of the first recess and the second recess, respectively, of the present invention, and the recess 47 is an example of the third recess of the present invention. The drainage passage opening 25 is an example of "the through-hole serving as the exit of the drainage passage" of the present invention.

Advantageous Effects

As described above, according to the exhaust top 11 with the foregoing configuration, it is possible to provide an inner space serving as part of the exhaust passage, and a drainage passage configured such that if condensed water is produced in the inner space, the condensed water is caused to flow out of the inner space by using such a simple method in which sheet metal components processed by drawing are combined.

In addition, since the drainage passage opening 25 serving as an exit of the drainage passage is formed in the flange 53, the drainage discharge pipe 15, which is connected to the drainage passage opening 25, can be disposed in a space adjacent to the recess 51.

Accordingly, by disposing the drainage discharge pipe 15 using the exhaust top 11, a back-and-forth dimension (in a direction perpendicular to abutting faces of the exhaust-top rear upper and rear lower components 31 and 32, and the exhaust-top front component 33) can be reduced, as compared with a case in which the exit of the drainage passage is formed in the bottom of the recess 51.

Additionally, the formation of the drainage passage opening 25 in the flange 53 makes it possible to form the drainage passage opening 25 at the same time of forming the recess 51 by drawing. Therefore, unlike a configuration in which the exit of the drainage passage is formed in a peripheral wall of the recess 51, the need to form the recess 51 and the drainage passage opening 25 by different processes can be obviated, and thus man hours for processing steps can be reduced.

Furthermore, by adjusting the depth of the recess 45, a maximum width of the space (the space at the boundary portion 57) serving as a drainage passage can be set arbitrarily. Therefore, the maximum width can be set to a narrow width that prevents entry of large foreign matter into the drain exhaust pipe 15.

The boundary portion 57 has an inclination at a downward gradient from the point P1, via the point P2, to the point P3. Therefore, foreign matter prevented from entering the drainage discharge pipe 15 at the boundary portion 57 gathers toward a lower end of the inclination along the inclination by its own weight. Accordingly, at least an upper end of the boundary portion 57 is made less likely to clog, and thereby a discharge passage for condensed water can be secured and maintained even when a lot of foreign matter has accumulated.

Further, since the bottom of the recess 45 has the recess 47 extending further from the bottom of the recess 45, a capacity of the discharge passage for condensed water to pass through can be increased compared with a case without the recess 47. Therefore, condensed water can be introduced to the drainage discharge pipe 15 more smoothly.

Additionally, the exhaust top 11 with the foregoing configuration may provide a structure in which a back-and-forth dimension is relatively small. This makes it possible to dispose the lower portion of the exhaust top 11 so as to overlap the primary heat exchanger 3, as in the foregoing embodiment, thus ensuring a sufficient capacity despite a compact size.

Other Embodiments

Although the embodiment of the present invention has been described above, it is to be understood that the present invention is not limited to the specific embodiment described above, and that the invention can be embodied in various other forms.

For example, the exhaust-top rear upper component 31 and the exhaust-top rear lower components 32, which are two separate components in the foregoing embodiment, may be composed as a single sheet metal component.

The description of the foregoing embodiment has been given of an example where the drainage passage opening 25 is formed at the same time of forming the recess 51 by drawing. However, the drainage passage opening 25 may be formed in a separate process after forming the recess 51 by drawing. However, from the viewpoint of reducing man hours for the processing steps, it is preferable that the drainage passage opening 25 be formed at the same time that the recess 51 is formed by drawing, as in the foregoing embodiment.

While the foregoing embodiment has been described using a specific form for each component, various modifications may be made to the specific forms or the like of the details as required without departing from the characteristics of the present invention.

What is claimed is:

1. An exhaust passage component comprising:

a first member, at least part of which including a first recess surrounded by a plate-like portion; and a second member, at least part of which including a second recess surrounded by a flange, wherein a boundary is defined between the second recess and the flange;

wherein the first and second members are joined, with the plate-like portion and the flange abutting each other, wherein an inner space is defined between the first member and the second recess, the first member has an upstream opening allowing exhaust to flow from upstream of the exhaust passage component into the inner space, and whereas the second member has a downstream opening allowing the exhaust to flow from the inner space to downstream of the exhaust passage component, and wherein the flange has a through-hole serving as an exit of a drainage passage, wherein the first recess overlaps only a portion of the boundary and overlaps the through-hole, as viewed from a direction perpendicular to abutting faces of the plate-like portion and the flange, thereby defining the drainage passage.

2. The exhaust passage component according to claim 1, wherein an overlapping portion is defined where the first recess overlaps the portion of the boundary, and wherein the overlapping portion has an inclination such that foreign matter blocked by the overlapping portion from entering the drainage passage gathers toward a lower end of the inclination.

3. The exhaust passage component according to claim 1 further comprising a third recess extending from the first recess in a direction away from the plate-like portion.

* * * * *